US009556009B2

(12) United States Patent
Li et al.

(10) Patent No.: US 9,556,009 B2
(45) Date of Patent: Jan. 31, 2017

(54) LABOR-SAVING DEVICE FOR DETECTION OF NO-LOAD HAND HOIST MOTION

(75) Inventors: Rui Li, Hangzhou (CN); Liang Wang, Hangzhou (CN); Minbo Yu, Hangzhou (CN); Zhihua Zhu, Hangzhou (CN); Zhouxuan Li, Hangzhou (CN); Hongyun Yu, Hangzhou (CN); Qun Yuan, Hangzhou (CN)

(73) Assignee: ZHEJIANG HUADIAN EQUIPMENT TESTING INSTITUTE, Hangzhou, Zhejiang (CN)

( * ) Notice: Subject to any disclaimer, the term of this patent is extended or adjusted under 35 U.S.C. 154(b) by 206 days.

(21) Appl. No.: 13/979,833

(22) PCT Filed: May 3, 2012

(86) PCT No.: PCT/CN2012/075014

§ 371 (c)(1),
(2), (4) Date: Jul. 15, 2013

(87) PCT Pub. No.: WO2013/063911

PCT Pub. Date: May 10, 2013

(65) Prior Publication Data

US 2013/0284993 A1 Oct. 31, 2013

(30) Foreign Application Priority Data

Nov. 3, 2011 (CN) ..... 2011 1 0342839

(51) Int. Cl.
*B66D 3/16* (2006.01)
*B66D 3/18* (2006.01)

(52) U.S. Cl.
CPC .. *B66D 3/16* (2013.01); *B66D 3/18* (2013.01)

(58) Field of Classification Search
USPC ..... 254/358
See application file for complete search history.

(56) References Cited

U.S. PATENT DOCUMENTS 3,432,145 A * 3/1969 Mudge ..... B66C 23/36 212/252
4,118,010 A * 10/1978 Hanscom ..... B66C 23/48 254/124

(Continued)

FOREIGN PATENT DOCUMENTS

| | | | |
|---|---|---|---|
| CN | 102393297 | A | 3/2012 |
| JP | 2008213966 | A | 9/2008 |
| KR | 20100060237 | A | 6/2010 |

*Primary Examiner* — Emmanuel M Marcelo
*Assistant Examiner* — Justin Stefanon
(74) *Attorney, Agent, or Firm* — Muncy, Geissler, Olds & Lowe, P.C.

(57) ABSTRACT

A labor-saving device for detection of no-load hand hoist motion, including a base, a stand pole, and a controller, a first cantilever beam, a second cantilever beam, a third cantilever beam, and a fourth cantilever beam being sequentially disposed in single vertical plane from top to bottom of the stand pole. Specifically, the electric hoist being disposed below the first cantilever beam; a pair of first guide unit being respectively disposed at two opposite laterals of the second cantilever beam; a driving unit including a motor, a stand plate, and an actuator being coaxially disposed in series from internal to external, being disposed above the third cantilever beam; and a pair of second guide unit are respectively disposed at two opposite laterals of the fourth cantilever beam.

9 Claims, 4 Drawing Sheets

(56) References Cited

U.S. PATENT DOCUMENTS

| | | | | |
|---|---|---|---|---|
| 4,223,554 | A | 9/1980 | Ulbing | |
| 2005/0145044 | A1 | 7/2005 | Dublin, Jr. | |
| 2006/0118359 | A1* | 6/2006 | Purvis | E04G 21/3204 182/3 |
| 2010/0163339 | A1* | 7/2010 | Han | A62B 1/02 182/18 |

* cited by examiner

LABOR-SAVING DEVICE FOR DETECTION OF NO-LOAD HAND HOIST MOTION

TECHNICAL FIELD

The present invention generally relates to a detecting device, in particular, the present invention relates to a detecting device for detection of no-load hand hoist motion, specifically a labor-saving device for implementing detection of the no-load hand hoist motion, more specifically relates to alternate the conventionally manual manner of repeatedly pulling the hand chain of hand hoist with a novel solution in virtue of said labor-saving device of the invention, thereby detecting whether the detecting of the on-load hand hoist motion meets the associated requirement.

BACKGROUND

The hand hoist is a kind of manual hoisting machinery, including generally hoisting chains, manual chains, arrester brake, and lifting hook, used for lifting weights or hanging various apparatus.

It is needed to implement no-load motion detection of the hand hoist for guaranteeing the proper operation and reliable, brake thereof in that hanging the hand hoist on a frame, and repeatedly pulling the manual chains in a manual manner to allowing for ascending and descending the lifting hook each time to detect flexibility associated with the machinery, and determine whether any defect phenomenon, such as block or timely loosen and tighten running exists. The conventional detecting method proceeded via repeatedly pulling the manual chains by operating personnel in manual manner causes low efficiency and high labor intensity, even bad labor environment like greasy dirt of the chains infected with the clothing of the personnel. There is a necessary need, therefore, for how to improve the existing detecting method by searching for a time and labor-saving machinery or device.

SUMMARY

The present invention fulfills the above needs and addresses or alleviates the aforementioned detects in manually operating the no-load detection in prior art, as well as others, by providing a reasonable a labor-saving device for implementing detection of the no-load hand hoist motion.

In one feature of the present invention, A labor-saving device for detection of no-load hand hoist motion, comprising a base, a stand pole, and a controller, a first cantilever beam, a second cantilever beam, a third cantilever beam, and a fourth cantilever beam being sequentially disposed in single vertical plane from top to bottom of the stand pole, which is characterized in that:

a electric hoist is disposed below the first cantilever beam;

a pair of first guide unit are respectively disposed at two opposite laterals of the second cantilever beam;

a driving unit including a motor, a stand plate, and an actuator being coaxially disposed in series from internal to external, is disposed above the third cantilever beam; the actuator includes an active wheel and two pressure regulator, the active wheel being configured to be a chain wheel or friction wheel, the two pressure regulator being symmetrically disposed at two opposite laterals of the active wheel and formed in the same plane thereof; each pressure regulator includes a passive wheel, an immovable frame, a movable frame, and a spring, a screw rod, a sleeve, a hand wheel, as well as a shaft pin, the passive wheel being configured to be a friction wheel is disposed within the movable frame, the movable frame is disposed within immovable frame, the immovable frame being disposed onto the stand plate; two elongated grooves, through which the shaft pin connected with the passive wheel traverses, are respectively formed in the mutually same portion of the front and rear lateral of the immovable frame; a circular hole is formed in the lateral far from the active wheel of the immovable frame, the screw rod is configured to fasten its one end with the lateral far from the active wheel of the movable frame and traverse another end through said circular hole in the immovable frame, the spring and the sleeve sequentially are suited on the screw rod, a protruded end of the screw rod from the sleeve is secured and screwed up by the hand wheel;

a pair of second guide unit are respectively disposed at two opposite laterals of the fourth cantilever beam.

The advantages of the labor-saving device for detection of no-load hand hoist motion of the invention features as following in that:

1) The hanging location of the hand hoist being set at the lifting hook of the electric hoist, which enabling vertically regulating the position of hook to facilitate arrangement of the hand hoist.

2) It is can be achieved that changing the active wheel with a chain wheel or frictional wheel in accordance with the requirement of the friction needed by the hand hoist chain.

3) The device being provided with simplified configuration and lower cost for mass manufacture.

According to a preferred embodiment of the labor-saving device for detection of no-load hand hoist motion of the present invention, wherein the active wheel is configured to be a chain wheel or friction wheel with notches formed in the peripheral circle portion thereof, allowing for excellent location of the manual chain at two opposite sides of the hand hoist to maintain running stability thereof during the detection process.

According to a preferred embodiment of the labor-saving device for detection of no-load hand hoist motion of the present invention, wherein the first guide unit or second guide unit with freely rotational function comprises a pair of polish rods respectively, each of polish rod including a inner rod and a sleeve tube sleeved and rotated around said inner rod, and preferably configured with friction material. The manual chain can activate vertically movement between said two polish rods. The sleeve tube is configured to be made with rubber or nylon texture, for guaranteeing the static frictional force existing between the sleeve tube and the manual chain with generated rolling rather than sliding movement, but also alleviating abrasion of the manual chain by the sleeve tube.

According to a preferred embodiment of the labor-saving device for detection of no-load hand hoist motion of the present invention, wherein the base includes a rubber panel for alleviating the noise generated by the manual chain scratching the base and abrasion of the base, and a metal baseboard beneath of which four trundles being arranged for location and arbitrary movement of the entire device of the invention.

According to a preferred embodiment of the labor-saving device for detection of no-load hand hoist motion of the present invention, wherein the controller is preferably configured to be a remote control or control cabinet, in another preferred embodiment of the present invention, the controller serving as a remote control is disposed to the stand pole, in yet another preferred embodiment of the present invention, the controller serving as a control cabinet is disposed between the first cantilever beam and second cantilever beam, and connected with the stand pole via a support which two end being respectively connectedly shafted with said stand pole and control cabinet. The support can be rotated around the stand pole, and the control cabinet can be rotated around the support. The control cabinet may be rotated to a position ease to be applied by the personnel in correspondence with the position thereof.

BRIEF DESCRIPTION OF THE ACCOMPANYING DRAWINGS

DETAILED DESCRIPTION OF THE PREFERRED EMBODIMENT

Figure 1:
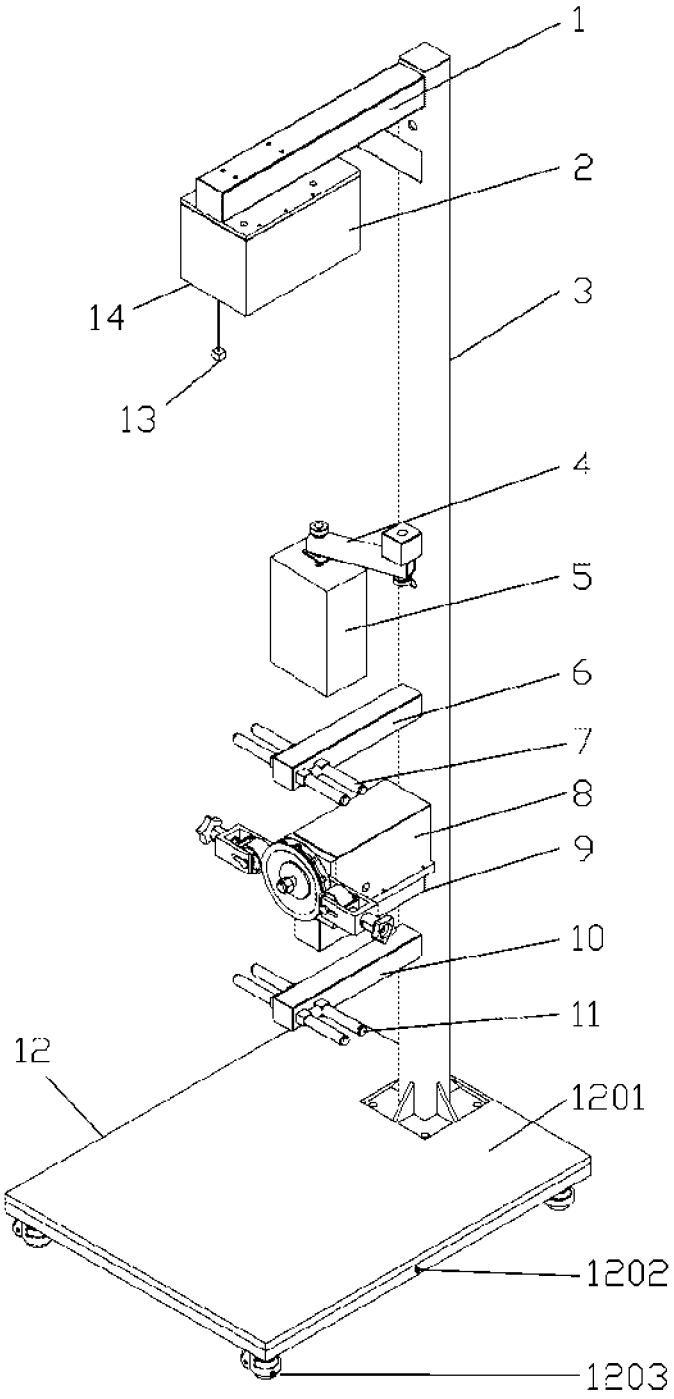
FIG. 1 shows a structural schematic diagram of a labor-saving device for detection of the no-load hand hoist motion of the present invention.
Figure 2:
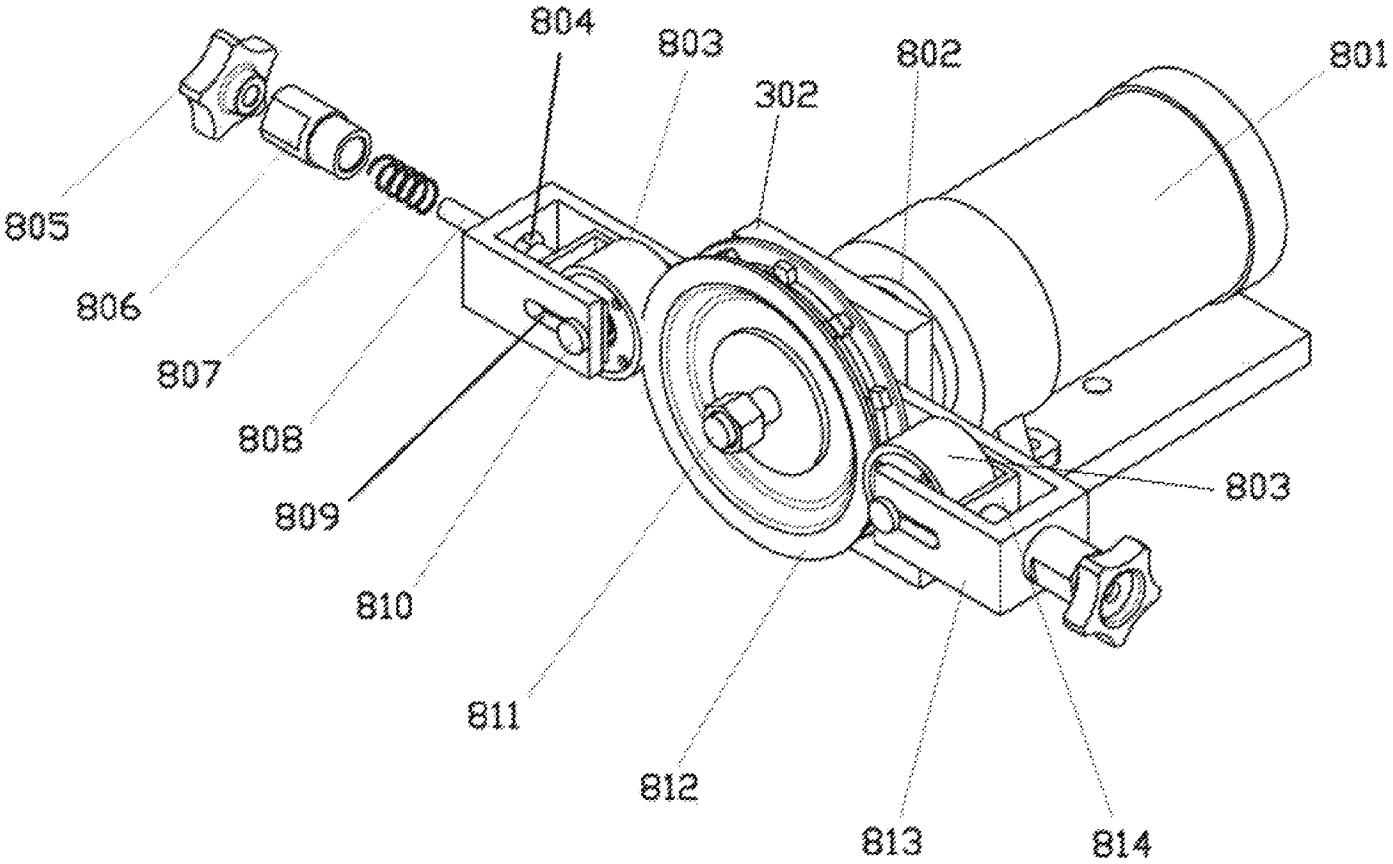
FIG. 2 shows a axonometric drawing of a driving unit of the present invention.
Figure 3:
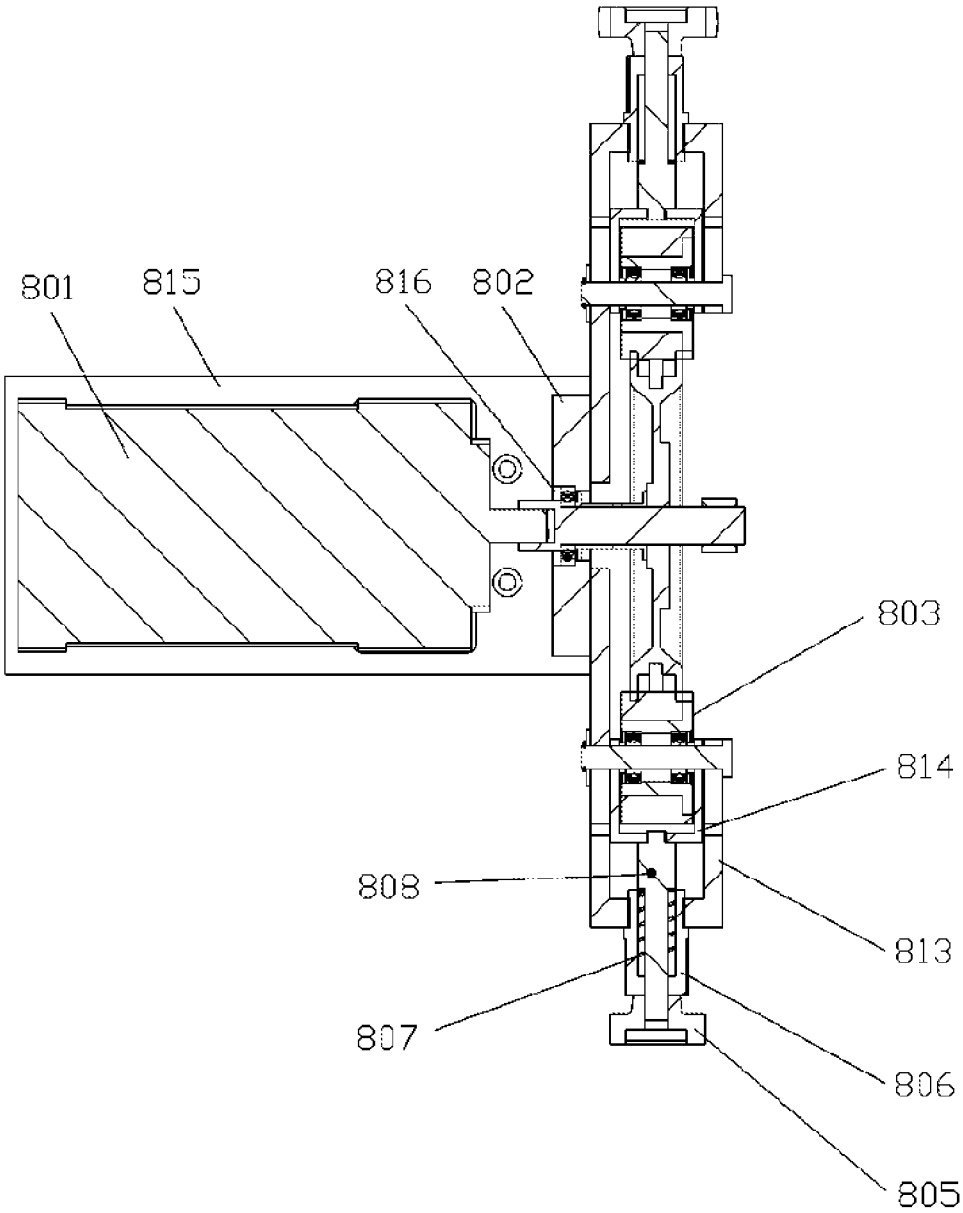
FIG. 3 shows a structural schematic diagram of the driving unit of the present invention.
Figure 4:
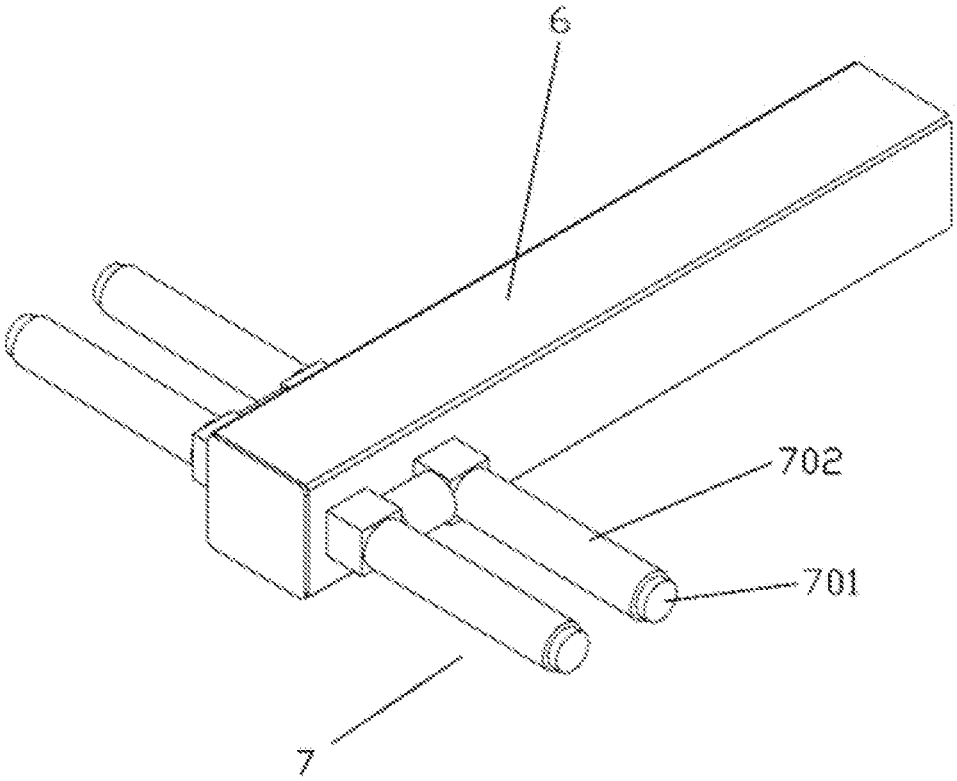
FIG. 4 shows a structural schematic diagram of a second cantilever beam and a guide unit of the present invention.

With reference now to the accompanying drawing, a preferred embodiment of the labor-saving device for detection of no-load hand hoist motion of the present invention comprises a base 12, a stand pole 3, and a controller 5, a first cantilever beam 1, a second cantilever beam 6, a third cantilever beam 9, and a fourth cantilever beam 10 being sequentially disposed in single vertical plane from top to bottom of the stand pole 3.

A housing 2 of the electric hoist is disposed below the first cantilever beam 1, wherein the electric hoist is fitted. A square opening 14, through which a lifting hook 13 can pass and further be connected with the hanging hook of the hand hoist, is formed at the undersurface of the housing of electric hoist.

A pair of first guide units 7 is respectively disposed at two opposite laterals of the second cantilever beam 6, wherein the first guide units 7 comprise a pair of polish rods respectively, each of polish rod including a inner rod 701 and a sleeve tube 702 sleeved and rotated around said inner rod 701, and configured with friction material. The sleeve tube 702 is preferably configured to be made with rubber or nylon texture.

A driving unit 8 including a motor 801, a stand plate 302, and an actuator being coaxially disposed in series from internal to external, is disposed above the third cantilever beam 9. A motor housing 815 is disposed on the motor 801 which being connected with the actuator through a central circular hole 816.

The actuator includes an active wheel 812 and two pressure regulators, the active wheel 812 being configured to be a chain wheel or friction wheel, the two pressure regulator being symmetrically disposed at two opposite laterals of the active wheel 812 and formed in the same plane thereof; each pressure regulator includes a passive wheel 803, an immovable frame 813, a movable frame 814, and a spring 807, a screw rod 808, a sleeve 806, a hand wheel 805, as well as a shaft pin 810, the passive wheel 803 being configured to be a friction wheel is disposed within the movable frame 814, the movable frame 814 is disposed within immovable frame 813, the immovable frame 813 being disposed onto the stand plate 802; two elongated grooves 809, through which the shaft pin 810 connected with the passive wheel 803 traverses, are respectively formed in the mutually same portion of the front and rear lateral of the immovable frame 813; a circular hole 804 is formed in the lateral far from the active wheel 812 of the immovable frame 813, the screw rod 808 is configured to fasten its one end with the lateral far from the active wheel 812 of the movable frame 814 and traverse another end through said circular hole 804 in the immovable frame 813, the spring 807 and the sleeve 806 sequentially are suited on the screw rod 808, a protruded end of the screw rod 808 from the sleeve 806 is secured and screwed up by the hand wheel 805. Controlling the moving direction of the passive wheel 803 by screwing the hand wheel 805 enables regulating the pressure between the active wheel 812 and the passive wheel 803. The spring 807 is configured to finely regulate the differential force generated by a cross connection between two adjacent chains with each other.

A pair of second guide units 11 with substantially same configuration as the first guide units 7 is respectively disposed at two opposite laterals of the fourth cantilever beam 10.

The control cabinet 5 is disposed between the first cantilever beam 1 and second cantilever beam 6, and connected with the stand pole 3 via a support 4 which two end being respectively connectedly shafted with said stand pole 3 and control cabinet 5. The support 4 can be rotated around the stand pole 3, and the control cabinet 5 can be rotated around the support 4. The control cabinet 5 may be rotated to a position ease to be applied by the personnel in correspondence with the position thereof.

The base 12 includes a rubber panel 1201 for alleviating the noise generated by the manual chain scratching the base and abrasion of a baseboard 1202, and the metal baseboard 1202 beneath of which a plurality of trundles 1203 being arranged for location and arbitrary movement of the entire device of the invention.

Each of the frictional wheel, and the polish rods of the guide units is configured to be made with rubber or nylon texture, for alleviating the abrasion of the chain with direct contact with the device of the invention.

The detection process of the invention features as following that: 1) controlling the lifting hook of the electric hoist to lift downwards to an appropriate position, and hanging the hanging hook of the hand hoist to the lifting hook, and then activating the electric hoist to enable motivating the hand hoist lifting adjacent to the first cantilever beam 1 by the drive of the lifting hook; 2) passing the manual chain at opposite sides of the hand hoist sequentially through the upper guide unit 7, the groove between active wheel 812 and the passive wheel 803, and the lower guide unit 11; 3) screwing the hand wheel 805 of pressure regulators to enable appropriately applying pressure to the chain with a friction force during vertical running, and preventing said frictional force resisting the smoothly vertical running thereof; 4) activating the control cabinet 5 to initiate the motor 801, thereby motivating the rotation of the active wheel 812 to promoting downwards vertical running of a chain at one side of the hand hoist and upwards vertical running of another chain at the other side of the hand hoist under action of said appropriate friction force.

It will be appreciated that the above-described embodiments are merely illustrative, and that those of ordinary skill in the art may readily devise their own implementations and modifications that incorporate the principles of the present invention and fall within the spirit and scope thereof.

The invention claimed is:

1. A labor-saving device for detection of no-load hand hoist motion, comprising a base, a stand pole, and a controller, a first cantilever beam, a second cantilever beam, a third cantilever beam, and a fourth cantilever beam being sequentially disposed in single vertical plane from top to bottom of the stand pole, the labor-saving device being characterized in that:

a electric hoist is disposed below the first cantilever beam;

a pair of first guide units is respectively disposed at two opposite laterals of the second cantilever beam;

a driving unit including a motor, a stand plate, and an actuator being coaxially disposed in series from internal to external, is disposed above the third cantilever beam;

the actuator includes an active wheel and two pressure regulator, the active wheel being configured to be a chain wheel or friction wheel, the two pressure regulator being symmetrically disposed at two opposite laterals of the active wheel and formed in the same plane thereof;

each pressure regulator includes a passive wheel, an immovable frame, a movable frame, and a spring, a screw rod, a sleeve, a hand wheel, as well as a shaft pin, the passive wheel being configured to be a friction wheel is disposed within the movable frame, the movable frame is disposed within immovable frame, the immovable frame being disposed onto the stand plate; two elongated grooves, through which the shaft pin connected with the passive wheel traverses, are respectively formed in the mutually same portion of the front and rear lateral of the immovable frame; a circular hole is formed in the lateral far from the active wheel of the immovable frame, the screw rod is configured to fasten its one end with the lateral far from the active wheel of the movable frame and traverse another end through said circular hole in the immovable frame, the spring and the sleeve sequentially are suited on the screw rod, a protruded end of the screw rod from the sleeve is secured and screwed up by the hand wheel;

a pair of second guide units is respectively disposed at two opposite laterals of the fourth cantilever beam.

2. The labor-saving device for detection of no-load hand hoist motion of claim 1, wherein the active wheel is configured to be a chain wheel or friction wheel with notches formed in a periphery thereof.

3. The labor-saving device for detection of no-load hand hoist motion of claim 1, wherein the passive wheel is configured to be a friction wheel.

4. The labor-saving device for detection of no-load hand hoist motion of claim 1, wherein the first guide units or second guide units comprises a pair of polish rod respectively, each of polish rod including a inner rod and a sleeve tube sleeved and rotated around said inner rod, and configured with friction material.

5. The labor-saving device for detection of no-load hand hoist motion of claim 4, wherein the sleeve tube is configured to be made with rubber or nylon texture.

6. The labor-saving device for detection of no-load hand hoist motion of claim 1, wherein the base includes a rubber panel, and a metal baseboard beneath of which a plurality of trundles being arranged.

7. The labor-saving device for detection of no-load hand hoist motion of claim 1, wherein the controller is configured to be a remote control or control cabinet.

8. The labor-saving device for detection of no-load hand hoist motion of claim 7, wherein the control cabinet is disposed to the stand pole.

9. The labor-saving device for detection of no-load hand hoist motion of claim 1, wherein a control cabinet is disposed between the first cantilever beam and second cantilever beam, and connected with the stand pole via a support which two end being respectively connectedly shafted with said stand pole and control cabinet.

* * * * *